US009257784B2

(12) United States Patent
Kawamoto et al.

(10) Patent No.: US 9,257,784 B2
(45) Date of Patent: Feb. 9, 2016

(54) POWER PLUG WITH MALE CONTACT DISPLACEMENT PREVENTION

(71) Applicant: PANASONIC CORPORATION, Osaka (JP)

(72) Inventors: Takashi Kawamoto, Mie (JP); Maki Kondou, Mie (JP); Ryota Tomiyama, Mie (JP); Tatsuya Takagi, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 23 days.

(21) Appl. No.: 14/271,874

(22) Filed: May 7, 2014

(65) Prior Publication Data

US 2014/0364014 A1 Dec. 11, 2014

(30) Foreign Application Priority Data

Jun. 5, 2013 (JP) ..... 2013-118948

(51) Int. Cl.

| | |
|---|---|
| ***H01R 13/04*** | (2006.01) |
| ***H01R 13/58*** | (2006.01) |
| ***H01R 13/424*** | (2006.01) |
| ***H01R 24/30*** | (2011.01) |
| *H01R 103/00* | (2006.01) |
| *H01R 13/504* | (2006.01) |
| *H01R 13/506* | (2006.01) |

(52) U.S. Cl.

CPC ..... *H01R 13/58* (2013.01); *H01R 13/424* (2013.01); *H01R 24/30* (2013.01); *H01R 13/04* (2013.01); *H01R 13/504* (2013.01); *H01R 13/506* (2013.01); *H01R 13/5812* (2013.01); *H01R 2103/00* (2013.01)

(58) Field of Classification Search

CPC .... H01R 13/652; H01R 43/24; H01R 13/506; H01R 23/02; H01R 24/28; H01R 2103/00; H01R 13/514

USPC ..... 439/106, 604, 606, 686, 689, 692, 439/694–696, 701

See application file for complete search history.

(56) References Cited

U.S. PATENT DOCUMENTS 2,047,094 A * 7/1936 Bennett ..... 439/598
3,259,871 A 7/1966 Chandler (Continued)

FOREIGN PATENT DOCUMENTS

DE 3108744 A1 9/1982
EP 1130688 A2 9/2001

(Continued)

OTHER PUBLICATIONS

Extended European Search Report in EP 14165662.9, dated Jan. 5, 2015.

(Continued)

*Primary Examiner* — Thanh Tam Le

(74) *Attorney, Agent, or Firm* — Greenblum & Bernstein, P.L.C.

(57) ABSTRACT

A plug includes male contacts, a core and an envelope. Each of the male contacts includes a stopper. The core includes a first member and a second member. The stoppers are in contact with the first member and the male contacts are in contact with the second member, so that the male contacts are prohibited from being displaced with respect to the core in a first direction along which the male contacts protrude from an end face of the core.

3 Claims, 4 Drawing Sheets

(56) References Cited

U.S. PATENT DOCUMENTS

| | | | | | |
|---|---|---|---|---|---|
| 3,611,257 | A | * | 10/1971 | Carkhuff | 439/587 |
| 5,222,911 | A | | 6/1993 | Moji | |
| 5,647,751 | A | * | 7/1997 | Shulman et al. | 439/106 |
| 5,971,733 | A | * | 10/1999 | Huang | 425/116 |
| 6,089,924 | A | * | 7/2000 | Wang | 439/694 |
| 6,190,212 | B1 | * | 2/2001 | Brown et al. | 439/736 |
| 6,231,358 | B1 | * | 5/2001 | Kerr et al. | 439/140 |
| 6,910,920 | B2 | * | 6/2005 | Su | 439/606 |
| 6,966,799 | B1 | * | 11/2005 | Wang | 439/694 |
| 7,491,081 | B2 | * | 2/2009 | Fehling et al. | 439/320 |
| 8,007,302 | B2 | * | 8/2011 | Kleinke | 439/275 |
| 8,734,178 | B2 | * | 5/2014 | Inagaki et al. | 439/369 |
| 2001/0019922 | A1 | | 9/2001 | Fuehrer et al. | |
| 2009/0170365 | A1 | | 7/2009 | Wang et al. | |
| 2013/0017713 | A1 | | 1/2013 | Asakuma et al. | |
| 2013/0017738 | A1 | | 1/2013 | Asakuma et al. | |
| 2014/0070629 | A1 | | 3/2014 | Kondou et al. | |
| 2014/0073189 | A1 | | 3/2014 | Kondou et al. | |

FOREIGN PATENT DOCUMENTS

| | | | |
|---|---|---|---|
| GB | 2050076 | | 12/1980 |
| GB | 2261777 | A | 5/1993 |
| JP | 55-126973 | | 10/1980 |
| JP | 5-144500 | | 6/1993 |
| JP | 07-067245 | | 3/1995 |
| JP | 2009-043509 | | 2/2009 |
| JP | 2010-225526 | | 10/2010 |
| JP | 2011-181261 | | 9/2011 |
| JP | 2013-058419 | | 3/2013 |
| KR | 10-2011-0098652 | | 9/2011 |
| TW | M323742 | | 12/2007 |

OTHER PUBLICATIONS

Korean Office Action in KR 10-2014-0055531, dated Feb. 26, 2015.

Search Report in Taiwanese application 103116130, dated Oct. 20, 2015.

* cited by examiner

POWER PLUG WITH MALE CONTACT DISPLACEMENT PREVENTION

TECHNICAL FIELD

The invention relates generally to plugs and, more particularly, to a power plug.

BACKGROUND ART

For example, Japanese Unexamined Patent Application Publication Number 2009-43509 A discloses a power cord. The power cord includes a plug that includes a core embedded into a front center of the plug and two blades supported by the core at a predetermined interval.

In the related art, there is a possibility that projection dimensions of the blades are dispersed with respect to the core before the core is embedded into the plug (an envelope), in manufacturing process.

SUMMARY OF THE INVENTION

The present invention has been achieved in view of the above circumstances, and an object thereof is to prevent male contacts (blades) from being displaced with respect to a core in manufacturing process.

A plug (1) of one aspect of the present invention includes male contacts (11, 12), a core (6) and an envelope (7). The male contacts (11, 12) each have electric conductivity and are to be connected with electric wires (41, 42) one by one. The core (6) has an end face (60) and retains the male contacts (11, 12). The envelope (7) is molded to cover the core (6) and part of each of the male contacts (11, 12). Each of the male contacts (11, 12) includes a base part (110, 120), a projection part (111, 121) which protrudes from the base part (110, 120) through the end face (60) of the core (6) in a first direction (D1), and a stopper (112, 122) which protrudes from the base part (110, 120) in a direction (D2, D3) perpendicular to the first direction (D1). The core (6) includes a first member (8) which has the end face (60) and the projection parts (111, 121) are inserted into, and a second member (9) combined with the first member (8). The stoppers (112, 122) are in contact with the first member (8) and the male contacts (11, 12) are in contact with the second member (9), so that the male contacts (11, 12) are prohibited from being displaced with respect to the core (6) in the first direction (D1).

In an embodiment, the plug (1) further includes a tension stopper (13) that is combined with the core (6) so that an end of a cord (4) including the electric wires (41, 42) is interposed between the tension stopper (13) and the core (6). The plug (1) is molded to the end of the cord (4) so that the envelope (7) covers the tension stopper (13) and the core (6) between which the end of the cord (4) is interposed.

In an embodiment, each of the stoppers (112, 122) is in contact with the first and second members (8, 9) on first and second sides of the first direction (D1), respectively.

In the aspect of the present invention, the stoppers are in contact with the first member, and the male contacts are in contact with the second member, thereby prohibiting the male contacts from being displaced with respect to the core in the first direction. As a result, it is possible to prevent the male contacts from being displaced with respect to the core before the envelope is formed in manufacturing process.

BRIEF DESCRIPTION OF THE DRAWINGS

The figures depict one or more implementations in accordance with the present teaching, by way of example only, bot by way of limitations. In the figures, like reference numerals refer to the same or similar elements:

FIG. 1A is a sectional view taken along an A-A line of FIG. 1C, FIG. 1B is a sectional view taken along a B-B line of FIG. 1A, and FIG. 1C is a sectional view taken along a C-C line of FIG. 1A;

FIGS. 3A, 3B, 3C and 3D are a front view, a plan view, a right side view and a back view of the second member.

DETAILED DESCRIPTION

Figure 1C:
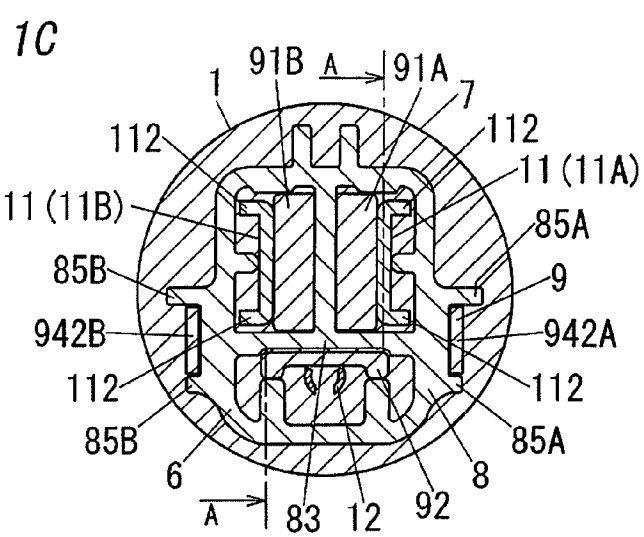
FIGS. 1A-1C show a plug in accordance with an embodiment of the present invention.

As shown in FIGS. 1A-1C and 2, a plug 1 in the present embodiment is, for example, a power plug that includes male contacts 11, 12, a core 6 and an envelope 7. The male contacts 11, 12 each have electric conductivity and are to be connected with electric wires 41, 42 one by one. The core 6 has an end face 60 and retains the male contacts 11, 12. The envelope 7 is molded to cover the male contacts 11, 12 and the core 6. That is, the plug 1 constitutes a power cord (a power plug cord) along with the cord 4.

Figure 2:
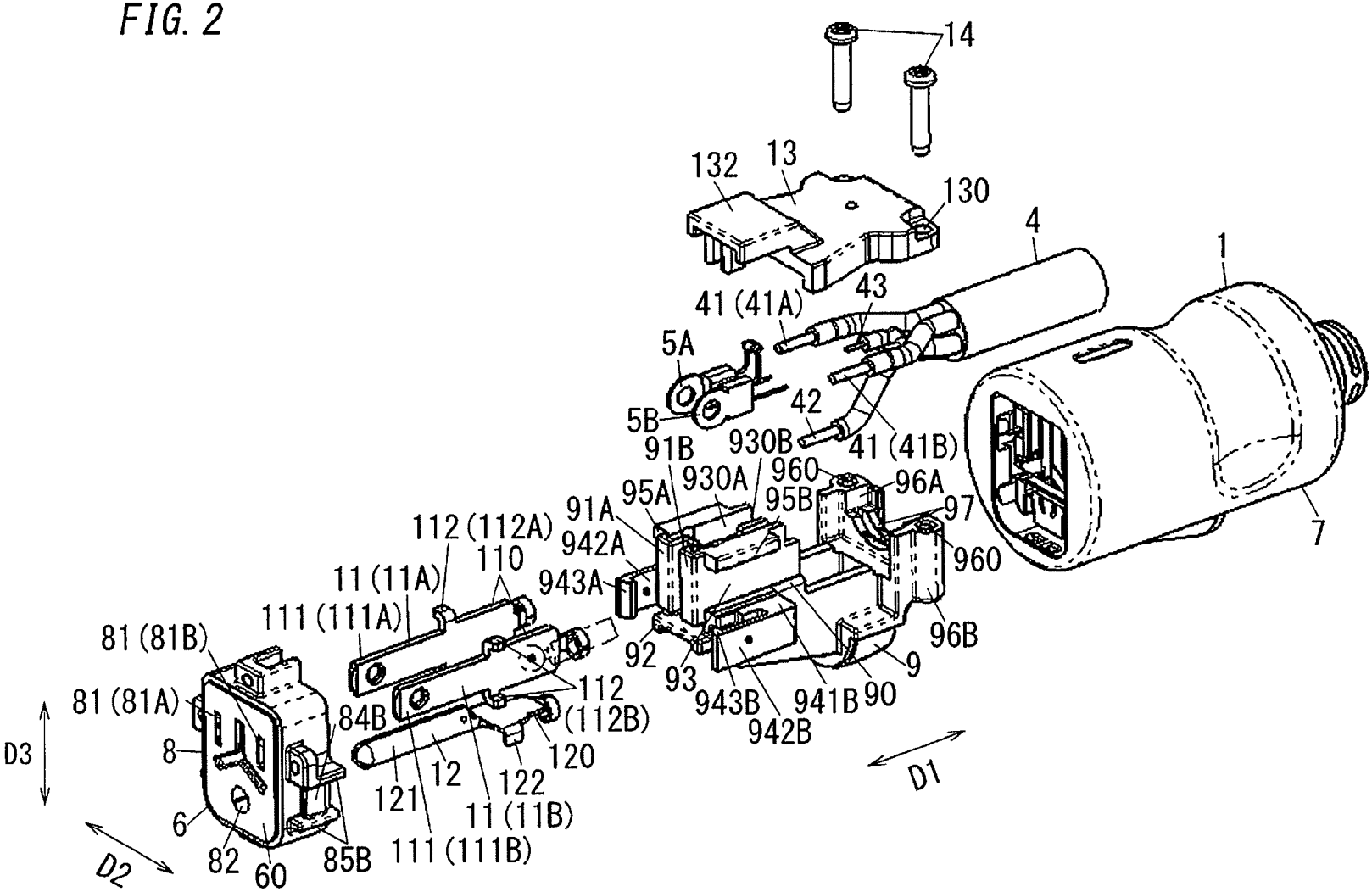
FIG. 2 is an exploded perspective view of the plug.
Figure 3D:
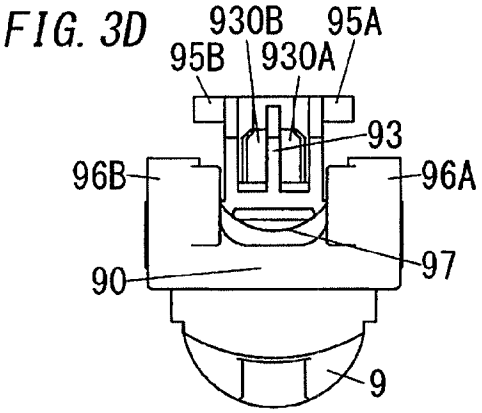
FIGS. 3A-3D show a second member included in the plug.
Figure 3C:
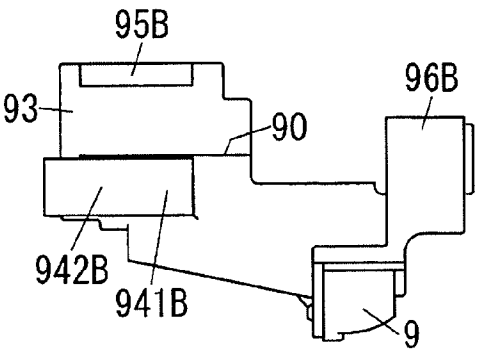
Figure 3B:
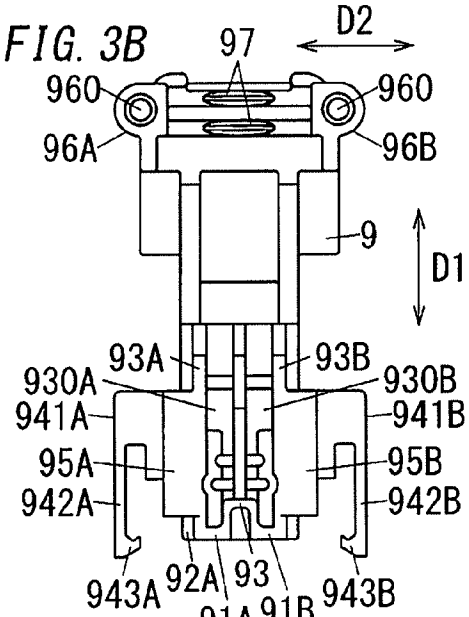
Figure 3A:
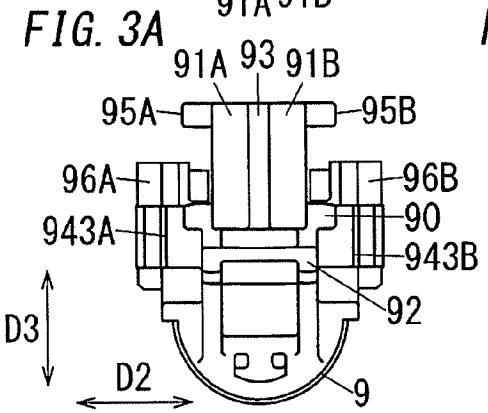

In an example of FIG. 2, the male contacts 11, 12 includes two blades 11A, 11B and a pin 12. Hereinafter, the blade 11A, the blade 11B and the pin 12 are also referred to as a "first male contact", a "second male contact" and an "earth male contact", respectively. The first and second male contacts 11A, 11B are connected to first and second electric wires 41(41A), 41(41B) included in a cord 4, respectively, while the earth male contact 12 is connected to an earth electric wire 42 included in the cord 4. The core 6 and part of each of the male contacts 11, 12 are covered with the envelope 7 that is formed from synthetic resin by insert injection molding. As another example, the plug 1 may include only the first and second male contacts 11A, 11B.

Each of the male contacts 11, 12 includes a base part 110, 120, a projection part 111, 121 which protrudes from the base part 110, 120 through the end face 60 of the core 6 in a first direction D1, and a stopper 112, 122 which protrudes from the base part 110, 120 in a direction D2, D3 perpendicular to the first direction D1. The projection parts 111, 121 and the base parts 110, 120 are arranged on first and second sides of the first direction D1, respectively. Hereinafter, the first side and the second side of the first direction D1 are also referred to as a "front side" and a "back side", respectively. In addition, a projection part 111 of the first male contact 11A and a projection part 111 of the second male contact 11B are also referred to as a "first projection part 111A" and a "second projection part 111B", respectively.

Specifically, the first and second male contacts 11A, 11B are shaped like a flat and respectively arranged on first and second sides of the second direction D2 so that thickness directions of the first and second male contacts 11A, 11B are in parallel with the second direction D2. Hereinafter, the first side and the second side of the second direction D2 are also referred to as a "left side" and a "right side", respectively. The flat projection part 111 protruding forward from the core 6 in the first male contact 11A is to be connected to a line side of receptacle contact in an outlet as a connection target. The flat projection part 111 protruding forward from the core 6 in the second male contact 11B is to be connected to a neutral side of receptacle contact in the outlet.

The first and second male contacts 11A, 11B are arranged on a first side of the third direction D3 perpendicular to the second direction D2, while the earth male contact 12 is arranged on a second side of the third direction D3. Hereinafter, the first side and the second side of the third direction D3 are also referred to as an "upside" and a "downside", respectively.

The first male contact 11A includes two stoppers 112 that protrude along the third direction D3 from both edges of the base part 110 at an intermediate position of the first male contact 11A and are bent toward the first side of the second direction D2. The second male contact 11B includes two stoppers 112 that protrude along the third direction D3 from both edges of the base part 110 at an intermediate position of the second male contact 11B and are bent toward the second side of the second direction D2. Each stopper 112 of the first and second male contacts 11A, 11B is more protruded than a neighboring projection part 111 in the third direction D3. Hereinafter, the stoppers 112 of the first male contact 11A and the stoppers 112 of the second male contact 11B are also referred to as "first stoppers 112A" and "second stoppers 112B", respectively.

In the example of FIG. 2, the earth male contact 12 is a pin contact. Specifically, the base part 120 is shaped like a flat and arranged so that a thickness direction of the base part 120 is in parallel with the third direction D3. The projection part 121 is shaped like a cylinder having an axis parallel with the first direction D1. The projection part 121 is to be connected to an earth side of receptacle contact in the outlet (not shown). The earth male contact 12 includes two stoppers 122 that protrude along the second direction D2 from both edges of the base part 120 at an intermediate position of the earth male contact 12 and are bent toward the second side of the third direction D3. The stoppers 122 are more protruded than the projection part 121 in the second direction D2, and also the base part 120 itself has a large size than the projection part 121 in the second direction D2.

The core 6 includes a first member 8 which has the end face 60 and the projection parts 111, 121 are inserted into, and a second member 9 combined with the first member 8. The first and second members 8, 9 are arranged on the front and back sides, respectively. Each of the first and second members 8, 9 is made from, for example, synthetic resin. The end face 60 of the first member 8 is exposed without being covered with the envelope 7 and defines a front face of the plug 1.

The first member 8 is shaped like, for example, a box having an opening on the second side of the first direction D1. In the example of FIG. 2, the end face 60 of the first member 8 is shaped like a right-angled quadrilateral. The first member 8 has a cavity 80 on the back side, and part of each of the male contacts 11, 12 is disposed in the cavity 80. The end face 60 of the first member 8 (a bottom of the cavity 80) is provided with a first through hole 81 (81A), a second through hole 81 (81B), and a third through hole 82 into which the first projection part 111A, the second projection part 111B, and the projection part 112 are inserted, respectively. The through holes 81A, 81B and 82 are formed to allow only the first projection part 111A, the second projection part 111B and the projection part 112 to be inserted into the through holes 81A, 81B and 82, respectively and to prohibit the first stoppers 112A, the second stoppers 112B and the stoppers 122 from being inserted into the through holes 81A, 81B and 82, respectively. In short, the first through hole 81A is slightly bigger than the first projection part 111A and smaller than the base part 110 including the first stoppers 112A. The second through hole 81B is slightly bigger than the second projection part 111B and smaller than the base part 110 including the second stoppers 112B. The third through hole 82 is slightly bigger than the projection part 121 and smaller than the base part 122 including the stoppers 122.

As shown in FIG. 1C, the first member 8 further includes a partition wall 83 shaped like a T. The partition wall 83 is protruded toward the back side from an inner bottom of the cavity 80 (a back face of the first member 8) so that the male contacts 11, 12 are separated from each other by the partition wall 83.

As shown in FIGS. 3A-3D, the second member 9 includes a body 90, a wall 93, and first and second interposing parts 95A, 95B. The first and second male contacts 11A, 11B are arranged on the upside, while the body 90 is arranged on the downside. The wall 93 is protruded toward the upside from an upper part of the body 90 and interposed between the first and second male contacts 11A, 11B. The wall 93 is a hollow wall including first and second outer walls 93A, 93B which are arranged on the first and second sides of the second direction D2 and extends in the first direction D1. The first interposing part 95A is protruded from an upper end of the first outer wall 93A toward the first side of the second direction D2 so that the first male contact 11A is interposed between the first interposing part 95A and the body 90. The second interposing part 95B is protruded from an upper end of the second outer wall 93B toward the second side of the second direction D2 so that the second male contact 11B is interposed between the second interposing part 95B and the body 90.

The second member 9 further includes a first projection part 91A, a second projection part 91B and a third projection part 92 at a front of the second member 9. The first and second projection parts 91A, 91B are arranged on the first and second sides of the second direction D2, respectively. The first and second projection parts 91A, 91B are also arranged on the first side of the third direction D3, while the third projection part 92 is arranged on the second side of the third direction D3. The first and second projection parts 91A, 91B and the third projection part 92 are inserted into the cavity 80 so that part of the partition wall 83 (a leg of the T-shaped partition wall) is interposed between the first and second projection parts 91A, 91B, while a remaining part thereof (a head) is interposed between the first and second projection parts 91A, 91B and the third projection part 92. That is, the first and second members 8, 9 are positioned to each other.

The second member 9 further includes first and second spring bases 941A, 941B and first and second flat springs 942A, 942B. The first spring base 941A is protruded from a front side of the first outer wall 93A toward the left side, while the second spring base 941B is protruded from a front side of the second outer wall 93B toward the right side. The first and second flat springs 942A, 942B are respectively protruded from the first and second spring bases 941A, 941B toward the first side of the first direction D1. The first and second flat springs 942A, 942B are arranged so that thickness directions thereof are in parallel with the second direction D2, and each front end side thereof is elastically deformable in the second direction D2. The first and second flat springs 942A, 942B have first and second hooks 943A, 943B at the front ends thereof, respectively. The first and second hooks 943A, 943B are protruded inwardly from inner faces of the first and second flat springs 942A, 942B, respectively.

Figure 1A:
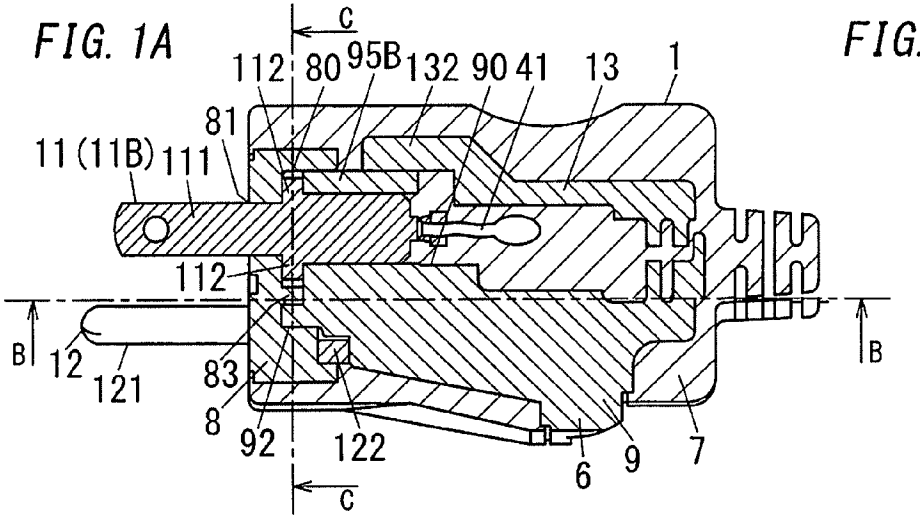
Figure 1B:
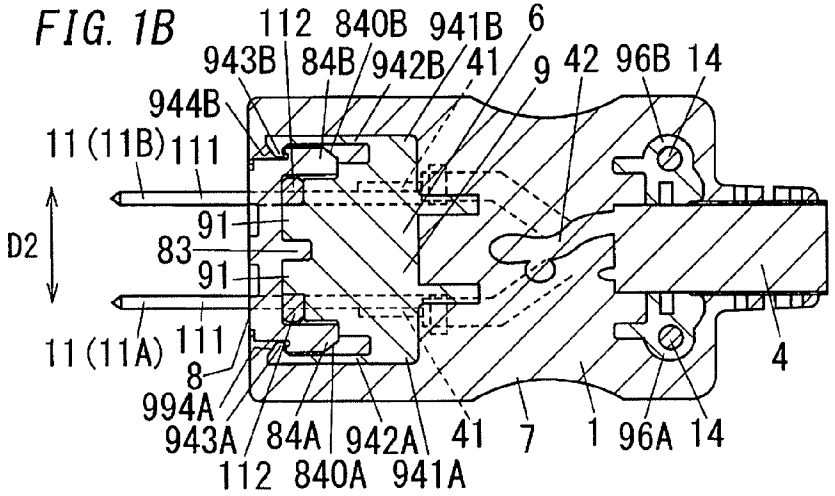

As shown in FIG. 1B, the first member 8 further includes first and second projection parts 84A, 84B that are protruded outwardly from both faces of the first member 8 on the first and second sides of the second direction D2. The first member 8 is interposed between the first and second flat springs 942A, 942B in the second direction D2, and the first and second hooks 943A, 943B are engaged with the first and second projection parts 84A, 84B, respectively. That is, the first and second hooks 943A, 943B are in contact with the first and second projection parts 84A, 84B from the front side, respectively, and the first member 8 is combined with the second member 9.

The first and second projection parts 84A, 84B have first and second slopes (inclined faces) 840A, 840B, respectively. The first slope 840A is formed so that a projected dimension of the first projection part 84A is gradually increased from a back end to an intermediate part of the first projection part 84A. The second slope 840B is formed so that a projected dimension of the second projection part 84B is gradually increased from a back end to an intermediate part of the second projection part 84B.

The first and second hooks 943A, 943B have first and second slopes 944A, 944B, respectively. The first slope 944A is formed so that a projected dimension of the first hook 943A is gradually increased from a front end to an intermediate part of the first hook 943A. The second slope 944B is formed so that a projected dimension of the second hook 943B is gradually increased from a front end to an intermediate part of the second hook 943B.

When the first member 8 is combined with the second member 9, the first member 8 is pressed between the first and second flat springs 942A, 942B of the second member 9 with the first and second projection parts 84A, 84B aligned with the first and second hooks 943A, 943B, respectively. The first and second slopes 944A, 944B are slid on the first and second slopes 840A, 840B, respectively, and thereby the first and second flat springs 942A, 942B are elastically deformed. The first and second hooks 943A, 943B reaches the front sides of the first and second projection parts 84A, 84B, and then the first and second flat springs 942A, 942B are elastically returned. As a result, the first and second hooks 943A, 943B are engaged with the first and second projection parts 84A, 84B, respectively.

As shown in FIGS. 1C and 2, the first member 8 further includes two first pinching ribs 85A and two second pinching ribs 85B. The first pinching ribs 85A are protruded from an outer face of the first member 8 on the left side so that the first flat spring 942A of the second member 9 is interposed between the first pinching ribs 85A in the third direction D3. The second pinching ribs 85B are protruded from an outer face of the first member 8 on the right side so that the second flat spring 942B of the second member 9 is interposed between the second pinching ribs 85B in the third direction D3.

The cord 4 including the electric wires 41, 42 is pulled out from part of the core 6 on the back side so that an end of the cord 4 (hereinafter referred to as a "connection end") is in parallel with the first direction D1. As shown in FIG. 2, the second member 9 further includes first and second screw bosses 96A, 96B formed at an end of the body 90 on the back side. The first and second screw bosses 96A, 96B are provided so that the connection end of the cord 4 is intervened between the first and second screw bosses 96A, 96B in the second direction D2 (a diameter direction of the connection end of the cord 4) and part of each of the first and second screw bosses 96A, 96B is protruded upward (toward the upside).

In the embodiment, the plug 1 further includes a tension stopper 13. The connection end of the cord 4 is interposed between the tension stopper 13 and the core 6 (the second member 9). The tension stopper 13 is housed in the envelope 7 along with the core 6 by insert molding. The tension stopper 13 is made from, for example, synthetic resin. Each of the first and second screw bosses 96A and 96B in the second member 9 is provided with a screw hole 960 opened in its own face on the upper side. The tension stopper 13 is provided with two screw through holes 130 communicate with the screw holes 960 one by one. The tension stopper 13 and the second member 9 are fixed with two screws 14 which are inserted into the screw through holes 130 and turned and pressed into the screw holes 960.

Figure 4:
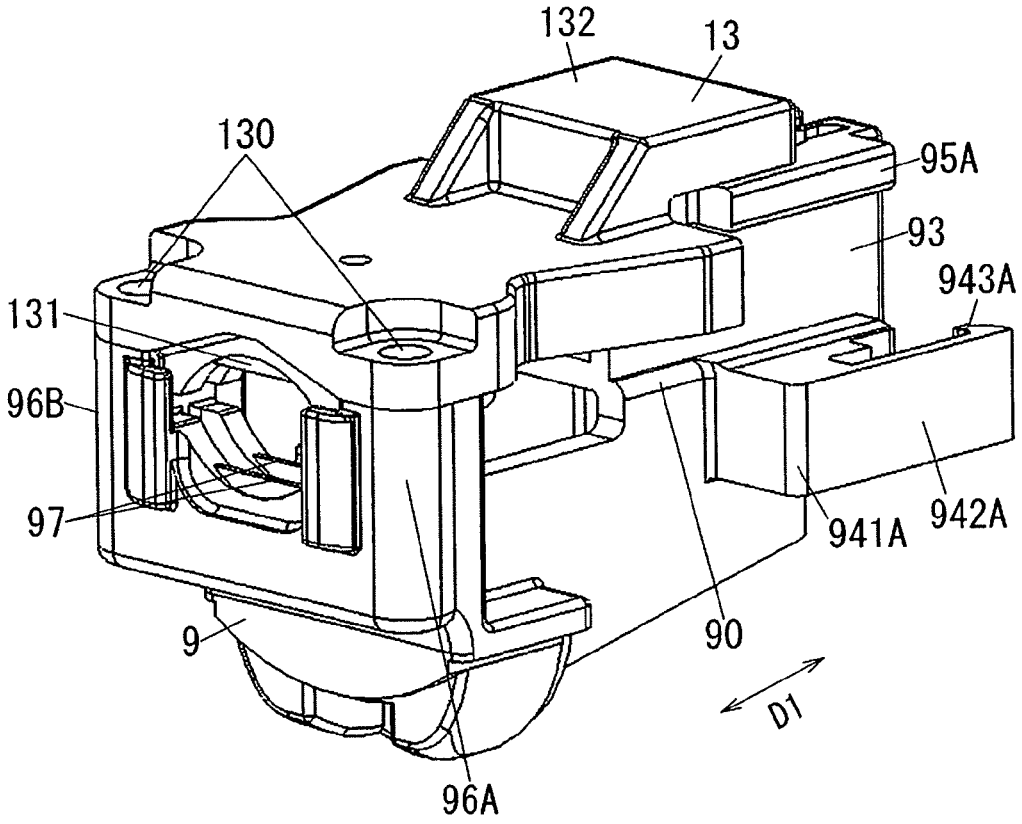
FIG. 4 is a perspective view of the second member combined with a tension stopper included in the plug.

As shown in FIG. 4, the second member 9 and the tension stopper 13 further include two retention ribs 97 and two retention ribs 131. Each retention rib 97 is shaped like a flat and the retention ribs 97 are spaced in the first direction D1 (an axis direction of the connection end of the cord 4) between the first and second screw bosses 96A, 96B of the second member 9. Each retention rib 131 is shaped like a flat and the retention ribs 131 are spaced in the first direction D1 so as to face the retention ribs 97. A distance between the retention ribs 97 and the retention ribs 131 with the second member 9 and the tension stopper 13 combined with each other is set to be smaller than an outer diameter of the undeformed cord 4. That is, the retention ribs 97 and the retention ribs 131 bite the cord 4, thereby preventing the cord 4 from falling out from the core 6.

As shown in FIG. 2, before the envelope 7 is formed, the male contacts 11, 12 are prohibited from being displaced with respect to the core 6 in the second and third directions D2, D3 by the through holes 81, 82 of the first member 8. The through holes 81, 82 of the first member 8 are formed to prohibit the stoppers 112, 122 of the male contacts 11, 12 from being inserted into. Therefore, the stoppers 112, 122 are in contact with the inner bottom of the cavity 80 of the first member 8, thereby prohibiting the male contacts 11, 12 from being displaced forward (toward a projection direction of the projection parts 111, 121) with respect to the core 6 (pulled out from the core 6). In addition, the second member 9 is disposed at the back side of the stoppers 112, 122 of the male contacts 11, 12. Therefore, the stoppers 112, 122 are in contact with the second member 9, thereby prohibiting the male contacts 11, 12 from being displaced backward (toward an opposite direction of the projection direction of the projection parts 111, 121) with respect to the core 6.

In short, the stoppers 112, 122 are in contact with the first member 8 and the male contacts 11, 12 are in contact with the second member 9, thereby prohibiting the male contacts 11, 12 from being displaced with respect to the core 6 in the first direction D1. In the example of FIGS. 1A and 1B, each of the stoppers 112, 122 is in contact with the first and second members 8, 9 on first and second sides of the first direction D1, respectively.

In the present embodiment, as shown in FIG. 2, the plug 1 further includes first and second thermal sensors 5A, 5B for detecting temperatures of the first and second male contacts 11A, 11B, respectively. Each of the first and second thermal sensors 5A, 5B can be realized by a well-known art using, for example, a thermistor, and is not described in detail herein.

The cord 4 further includes signal wires 43 through which each output of the first and second thermal sensors 5A, 5B can be extracted. For example, each output of the first and second thermal sensors 5A, 5B is to be used for control for disconnecting between the electric wires 41 for electric power transmission and a load (not shown) when a detected temperature is equal to or more than a predetermined temperature. The second member 9 has first and second housing cavities 930A, 930B opened from the upper and back sides of the wall 93, and the first and second thermal sensors 5A, 5B are disposed in the first and second housing cavities 930A, 930B and held by the second member 9. That is, the first outer wall 93A of the second member 9 intervenes between the first thermal sensor 5A and the first male contact 11A, while the second outer wall 93B intervenes between the second thermal sensor 5B and the second male contact 11B. As shown in FIG. 4, the tension stopper 13 has a covering 132 that covers the first and second housing cavities 930A, 930B with the tension stopper 13 combined with the second member 9.

As an example, the first member 8 and the second member 9 may be combined with one or more screws in place of or along with engagement described above.

In the present embodiment, as shown in FIG. 2, before the envelope 7 is formed, the male contacts 11, 12 are prohibited from being displaced with respect to the core 6 in the second and third directions D2, D3 by the through holes 81, 82 of the first member 8. The through holes 81, 82 of the first member 8 are formed to prohibit the stoppers 112, 122 of the male contacts 11, 12 from being inserted into. Therefore, the stoppers 112, 122 are in contact with the inner bottom of the cavity 80 of the first member 8, thereby prohibiting the male contacts 11, 12 from being displaced forward (toward the projection direction of the projection parts 111, 121) with respect to the core 6 (pulled out from the core 6). In addition, the second member 9 is disposed at the back side of the stoppers 112, 122 of the male contacts 11, 12. Therefore, the stoppers 112, 122 are in contact with the second member 9, thereby prohibiting the male contacts 11, 12 from being displaced backward (toward the opposite direction of the projection direction of the projection parts 111, 121) with respect to the core 6. Thus, it is desirable that the second member 9 be in contact with the male contacts 11, 12 from the back side. For example, the second member 9 may be contact with ends of the male contacts 11, 12 on the back side not contact with the stoppers 112, 122.

In the present embodiment, it is possible to prevent the male contacts 11, 12 from being displaced with respect to the core 6 before the envelope 7 is formed in manufacturing process.

It is also possible to prevent the cord 4 from being displaced with respect to the core 6 before the envelope 7 is formed in manufacturing process in comparison with a case where the tension stopper 13 is not provided. Therefore, even when force is applied to the cord 4, a stress is prevented from being exerted on each connection part between the male contacts 11, 12 and the electric wires 41, 42 and each connection part between the first and second thermal sensors 5A, 5B and the signal wires 43.

In the aforementioned embodiments, the plug 1 includes, as the first and second male connectors, two blades 11 which have thickness directions parallel with the second direction D2 and correspond to line (hot) and neutral, such as JIS C 8303 plug, NEMA 1-15 plug, NEMA 5-15 plug or the like, but the present invention is not limited to this. For example, a plug in an embodiment of the present invention may include as the first and second male connectors: two blades which have thickness directions parallel with the third direction D3, such as BS 1363 plug or the like; two blades forming a V-shape or an upside down V-shape, such as CPCS-CCC plug, AS/NZS 3112 plug or the like; or two round pins such as BS 546 plug, BS 4573 plug, CEE 7/4 plug, CEE 7/5 plug, CEE 7/16 plug, CEE 7/17 plug, 107-2-D1 plug, CEI 23-16/VII plug, SEV 1011 plug, IEC 60906-1 plug, TIS 166-2549 plug or the like.

In the aforementioned embodiments, the plug 1 further includes, as an earth male connector (option), a pin 12 which has a U-shape cross-section or is shaped like a hollow cylinder, but the present invention is not limited to this. For example, a plug in an embodiment of the present invention may include a pin having a U-shape cross-section. A plug in an embodiment of the present invention may also include as an earth male connector: a blade such as AS/NZS 3112 plug, BS 1363 plug or the like; a half round earth pin such as 107-2-D1 plug or the like; or a round earth pin such as CEI 23-16/VII plug, SEV 1011 plug, NEMA 5-15 plug, TIS 166-2549 plug or the like.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A power plug, comprising:

male contacts to be connected with electric wires one by one, the male contacts each having electric conductivity;

a core which has an end face and retains the male contacts; and an envelope molded to cover the core and part of each of the male contacts, wherein each of the male contacts comprises a base part, a projection part which protrudes from the base part through the end face of the core in a first direction, and a stopper which protrudes from the base part in a direction perpendicular to the first direction, the core comprises a first member which has the end face and the projection parts are inserted into, and a second member combined with the first member, the stoppers are in contact with the first member and the male contacts are in contact with the second member, so that the male contacts are prevented from being displaced with respect to the core in the first direction, and the power plug further comprises a tension stopper that is combined with the core so that an end of a cord including the electric wires is interposed between the tension stopper and the core, the plug being molded to the end of the cord so that the envelope covers the tension stopper and the core between which the end of the cord is interposed.

2. The power plug of claim 1, wherein each of the stoppers is in contact with the first and second members on first and second sides of the first direction, respectively.

3. The power plug of claim 1, wherein each of the stoppers is in contact with the first and second members on first and second sides of the first direction, respectively.

* * * * *